United States Patent [19]

Wilson et al.

[11] 4,146,897

[45] Mar. 27, 1979

[54] ANTENNA MAST

[75] Inventors: John A. F. Wilson; John Ganton, both of Victoria, Canada

[73] Assignee: Her Majesty the Queen in right of Canada, as represented by the Minister of National Defence, Ottawa, Canada

[21] Appl. No.: 869,441

[22] Filed: Jan. 16, 1978

[30] Foreign Application Priority Data

Feb. 24, 1977 [CA] Canada ..... 272631

[51] Int. Cl.[2] ..... H01Q 1/18

[52] U.S. Cl. ..... 343/882; 343/DIG. 1

[58] Field of Search ..... 343/DIG. 1, 880, 881, 343/882, 886

[56] References Cited

U.S. PATENT DOCUMENTS

| | | | |
|---|---|---|---|
| 1,569,325 | 1/1926 | Leib | 343/882 |
| 2,076,222 | 4/1937 | Bruce | 343/886 |
| 3,701,159 | 10/1972 | Simonds | 343/886 |

*Primary Examiner*—Eli Lieberman

*Attorney, Agent, or Firm*—Murray & Whisenhunt

[57] ABSTRACT

A readily assembled self-supporting structure for carrying an antenna and associated electronics apparatus includes a tripod base having support means for pivotably supporting a top mast on which the antenna and associated apparatus are mounted. Pivotably joined with the support means, a mast engaging member is adapted to swing in a predetermined direction to either raise or lower the mast. A heavy battery pack used to power the apparatus is pendulously suspended from the member below the support means and stabilizes the structure against wind forces without requiring ground anchors. In addition, the battery pack acting about the pivot erects the top mast in a perpendicular attitude irrespective of the slope of the antenna site. The structure is held rigid by means of three guys between the top of the mast and the feet of the tripod. One of the guys may be removed to allow the mast to swing when the battery is raised and the tripod legs are prevented from splaying at ground level by a continuous loop of wire rope passing through support pads on which the base rests.

8 Claims, 5 Drawing Figures

ANTENNA MAST

FIELD OF THE INVENTION

This invention relates to self-supporting, portable antenna masts and more particularly to self-erecting antenna masts that are readily assembled and disassembled.

DESCRIPTION OF THE PRIOR ART

Antenna masts, including masts that are anchor guyed as well as masts that are self-supporting, are known in the art but have limited application under severe environmental conditions. In particular, erection of an antenna mast is extremely difficult under permafrost conditions or where the terrain may be frozen, snow-covered rocks. These conditions do not permit simple ground anchoring, and a vertical mast having even a moderately heavy top load could not be easily erected by hand, especially if installers are exposed to severe wind loads and icing as is commonly experienced in high Arctic latitudes.

Another difficulty that is present under the foregoing conditions stems from unevenness of terrain which may be caused by drifting snow or geographical features of the antenna site. Under these conditions, proper orientation of an antenna is difficult. Moreover, in view of the severity of the environment, the installation must be capable of rapid assembly on almost any unprepared, sloping site in order to minimize exposure hazards to personnel. In most instances, sites would not even have been surveyed before installation of the antenna so that this latter requirement is particularly important.

SUMMARY OF THE INVENTION

A provision of the present invention is an antenna mast that is self-supporting.

Another provision of the present invention is an antenna mast that does not require either burial in the terrain or ground anchors.

A further provision of the invention is an antenna mast that is partly self-erecting.

A still further provision of the invention is an antenna mast having a swinging top mast that permits antenna or electronic apparatus repairs at ground level.

Still another provision of the invention is an antenna mast that compensates for terrain slope and maintains the top mast in a substantially perpendicular attitude.

The foregoing disadvantages of the prior art may be substantially overcome and the aforenoted provisions achieved by recourse to the invention which is an antenna mast having a base including support means for pivotably supporting a superstructure. The mast further includes pivot means cooperatively engaging the support means, a mast engaging member upstanding from the pivot means for carrying the superstructure, and link means secured to the pivot means and depending downwardly therefrom in generally coaxial alignment with the mast engaging member. Ballast means are suspended from the link means for stabilizing the mast by establishing a centre of gravity below the support means and for pivotably maintaining the mast engaging member in a substantially perpendicular attitude.

The invention will now be more particularly described with reference to an embodiment thereof shown, by way of example, in the accompanying drawings.

DESCRIPTION OF THE ILLUSTRATED EMBODIMENT

Figure 1:
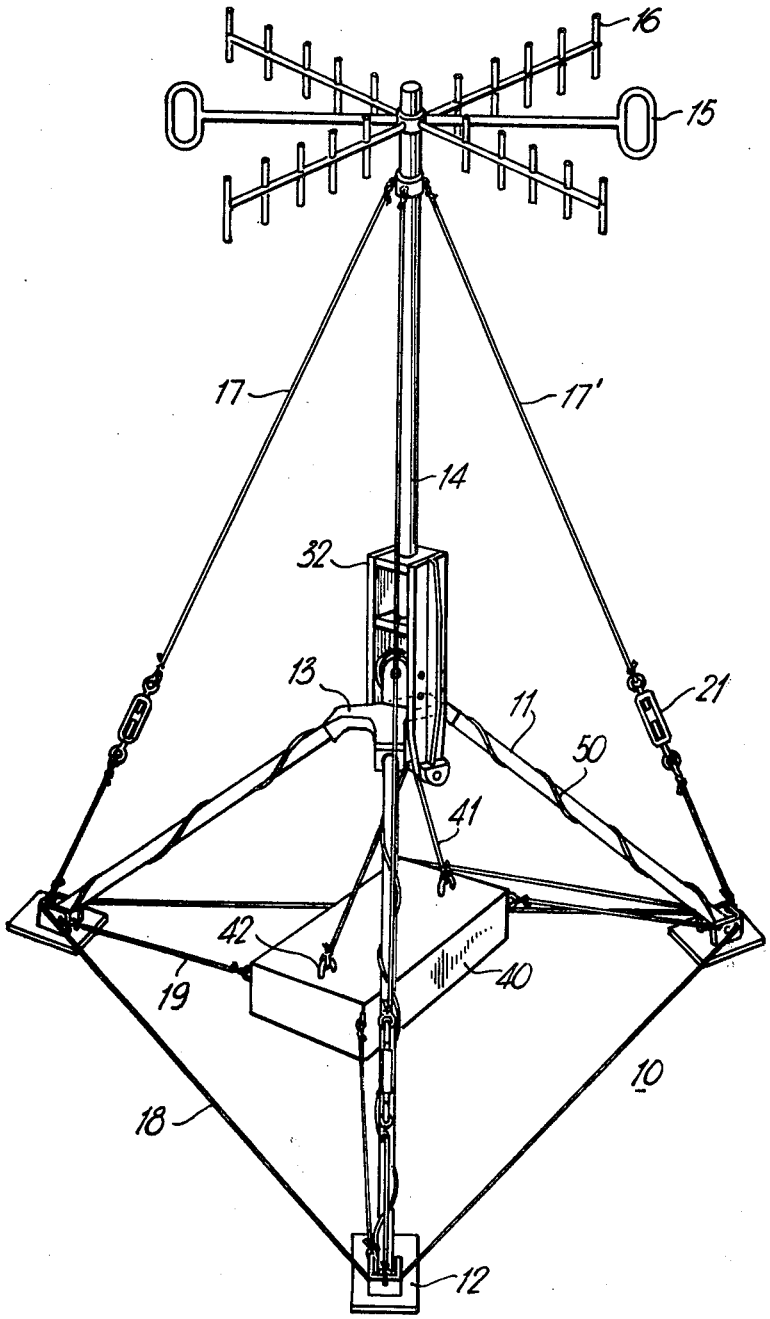
FIG. 1 is a perspective view of an erected antenna mast according to the subject invention.

A perspective view of an antenna mast 10 fabricated in accordance with the invention of the present application may be seen in FIG. 1. According to the illustration, the mast 10 includes a base shown in the form of a tripod having tubular legs 11. The apex of the tripod comprises the uppermost ends of the tubular legs 11 rigidly joined together by support means, shown as a centre pivot block 13 which is adapted to pivotably support a superstructure. Each leg 11 is seen to have a free end resting on an unconstrained universal joint forming part of a support pad 12.

It will be noted that the superstructure illustrated comprises a tubular top mast 14 atop which is mounted a pair of dipole antennas 15 together with their associated corner reflectors 16.

The structure of the antenna mast is maintained substantially rigid by means of a system of guys. A circular ground line 18 is passed through holes drilled in each support pad 12 and interconnects the free ends of the legs 11. The upper portion of the mast 14 is held vertical by three guys 17. Thus all four structural members of the mast are in compression about the block 13, and are stabilized by three shared guys 17 and the ground line 18.

Disposed above and alongside the pivot block 13 are pivot means illustrated more clearly and in greater detail in FIGS. 2, 3, 4 and 5 as a universal joint. The pivot means are shown to comprise, in part, a centre pivot link 20 having through holes 22 and 23 disposed at respective ends thereof. It will be seen in FIG. 2 that the hole 22 is disposed along an axis 24 and that the hole 23 is disposed along an axis 25 which is orthogonal to the axis 24. The pivot link 20 is shown adapted to slidably fit between a pair of support arms 26 which are upstanding from the pivot block 13. Furthermore, it will be observed that each arm 26 has a hole 27 formed along the axis 24 and that when the pivot link 20 is inserted between the arms 26, the hole 22 is in alignment with the holes 27. A top pivot shaft 28 pivotably joins the pivot link 20 with the pivot block 13 as indicated in the exploded view of FIG. 2 and is secured with suitable fastening means such as a locking pin (not shown).

In order to clearly show the various pivoting axes of the mast 10, the same axes which are represented in the various figures of the drawings are identified by the same number.

Figures 2, 3, 4, 5:
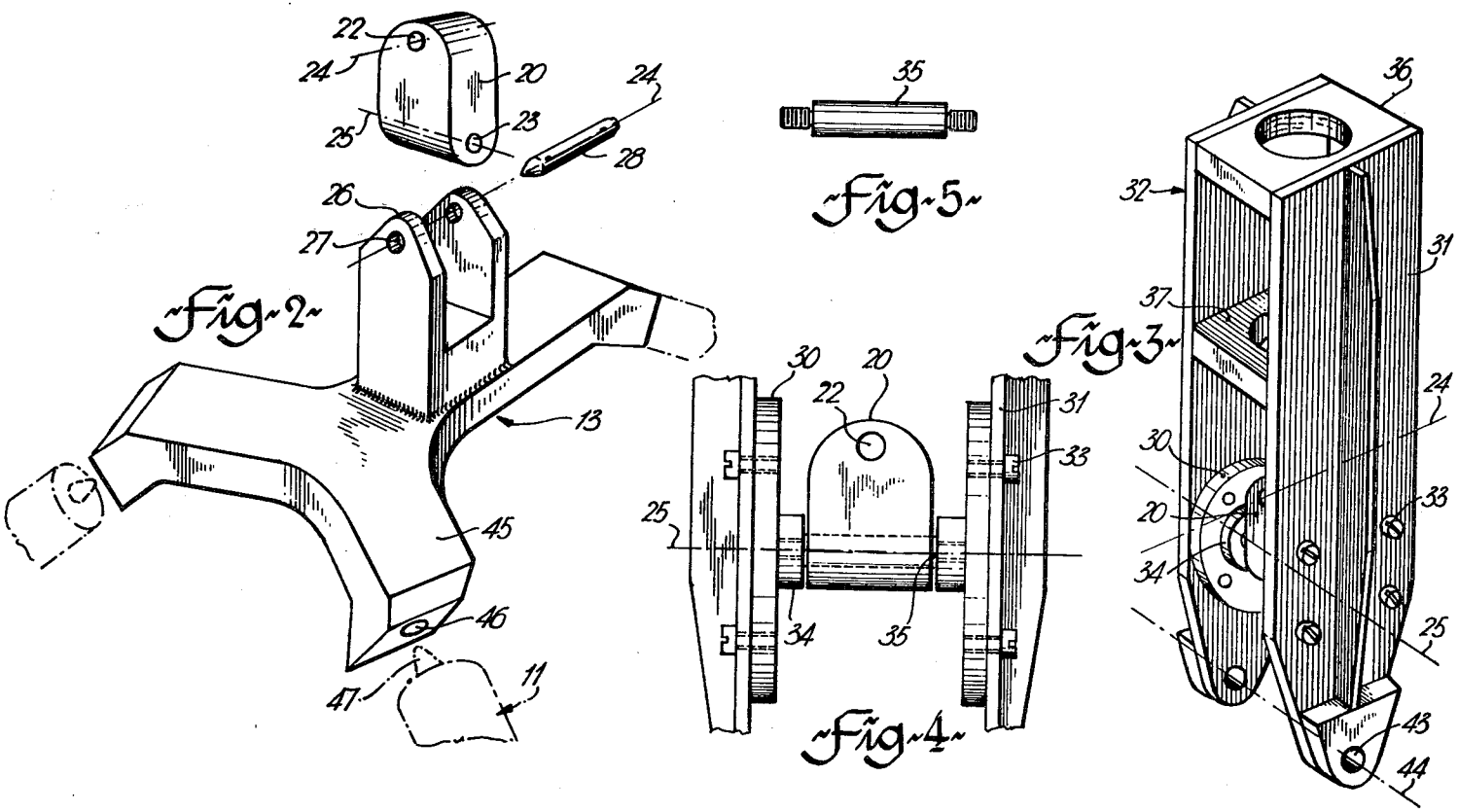
FIG. 2 is a perspective view, shown enlarged and with portions broken away, of a portion of the mast illustrated in FIG. 1 and indicating the manner of assembly.
FIG. 3 is an enlarged perspective view of another portion of the mast shown in FIG. 1.
FIG. 4 is a front elevation view, shown enlarged and with portions broken away, of a portion of a universal joint used in the antenna mast of FIG. 1.
FIG. 5 is a plan view of a pin used in connection with the universal joint illustrated in FIG. 4.

The remaining structure of the pivot means may be seen in FIGS. 3, 4 and 5. Thus, in FIGS. 3 and 4 there is shown a pair of flanges 30 which are mounted in opposed facing relation between a pair of parallel arms 31 of a mast socket bracket 32. A perspective view of the bracket 32 complete with the assembly of the flanges 30 and the pivot link 20 may be seen in FIG. 3. A front elevation view is shown in FIG. 4 wherein it will be observed that the flanges 30 are secured to the arms 31 by screws 33. A raised central hub 34 of each flange 30 is drilled and tapped to receive the threaded ends of a bottom pivot shaft 35, shown in FIG. 5, which pivotably connects the pivot link 20 to the flanges 30.

Referring again to FIG. 3, the bracket 32, which is employed as a mast engaging member, is shown to have its parallel arms 31 spaced apart by means of spacers 36 and 37. Each of the spacers are formed as shown to provide a socket arrangement adapted to receive and mechanically secure the bottom end of the mast 14. It will be noted that the arms 31 are generally in coaxial alignment with the spacers 36 and 37 and therefore will be similarly aligned with the mast 14.

The lowermost end of the bracket 32 is disposed below the pivot block 13 as illustrated in FIG. 1 and serves as link means from which is suspended ballast means employed to establish a centre of gravity for the mast 10 below the pivot block 13. The ballast means comprise a box which contains a battery and is shown as a battery pack 40 used to power a receiver-amplifier-transmitter chain (not shown) which would normally be located at the upper end of the mast 14. It will be observed that the battery pack 40 is suspended by means of a wire cable 41 anchored thereto by way of fasteners 42. According to FIG. 3, the lowermost end of the bracket 32 is formed to provide holes 43 disposed along an axis 44, the holes being adapted to receive a pin, similar to the pivot shaft 28, over which the cable 41 is looped.

If the battery pack 40 was just hanging freely from the pin disposed along the axis 44, wind gusts would cause it to swing with the possibility of damaging the tripod. It is therefore secured to all three support pads 12 with ropes 19 to prevent swing.

Referring again to FIG. 2 and to the pivot block 13, it will be noted that the block includes arms 45 which provide convenient anchor means for quickly connecting the block to the uppermost ends of each leg 11. Each arm 45 thus includes a socket 46 into which fits a tapered projecting pin 47 of each leg 11.

In the universal joint arrangement of the drawings, herein referred to as pivot means, it is important to note that the axis 24 is arranged in line with one of the arms 45. This configuration is required to allow the arms 31 of the bracket 32 to straddle the pivot block 13 in order to permit swinging the mast 14 so that the superstructure may be raised or lowered.

As illustrated in FIG. 1, the top of the mast 14 is guyed to the legs 11 which are in turn guyed to each other. The mast 10 is therefore rigid and is held stable on the ground against wind forces by the weight of the battery pack 40 which is pendulously supported by the cable 41 as described. In this regard, the battery pack 40 is suspended above the ground so that it is not likely to be buried by drifting snow.

Access to the antennas and electronics hardware mounted on top of the mast 14 is readily achieved by swinging the mast 14 about the pivot means to bring its upper end within convenient reach of operating and maintenance personnel. This is accomplished by releasing a guy 17' at a turnbuckle 21 adjacent to the support pad 12 and employing a chain block (not shown) hanging from the block 13 to lift the battery pack 40 thereby. Thereafter, the released guy 17' may be used to control the mast 14 as it swings downwardly as described.

When it is required to raise the mast 14, the battery pack 40 is lowered on the chain block to supply the lift force as the weight of the battery pack is transferred to the cable 41. In this way, the mast 10 is partly self-erecting due to the counterbalancing effect of the battery pack 40. Furthermore, the upright attitude of the mast 14 is maintained, within limits permitted by the free movement of the pivot means, irrespective of terrain slope because of the counterbalancing effect. Under conditions of uneven terrain, the three guys 17 leading downwards from the upper end of the mast 14 may be adjusted by the turnbuckles 21 in order to set the mast 14 upright.

In wind velocities of up to approximately 50 knots, all structures are liable to vibration induced by eddy shedding, and if the resonant frequency of the structure is close to the excitation frequency, structure failure is probable. Vibration of the tripod members due to eddy shedding was eliminated in the mast 10 by the addition of rope spoilers 50 which are secured in spiral form with adhesive along the length of each leg 11.

It will be apparent to those skilled in the art that the preceding description of the embodiment of the invention may be substantially varied to meet specialized requirements without departing from the spirit and scope of the invention disclosed. The foregoing embodiment is therefore not to be taken as limiting but rather as an exemplary structure of the invention which is defined by the claims.

We claim:

1. A self-supporting antenna mast assembly, comprising:

(a) a base composed of legs joined at the uppermost ends thereof to form a tripod having an apex;

(b) a mast operatively connected to said base;

(c) a support means disposed at said apex for pivotably supporting said mast, said support means including a pair of upstanding spaced apart pivot support arms, each arm having an aperture, said apertures being generally in serial alignment with one leg of said tripod;

(d) a pivot means operatively connected to said pivot support arms for permitting pivotable movement of said mast;

(e) a mast engaging means for carrying said mast, said mast engaging means being pivotably connected to said pivot means and upstanding therefrom to allow pivotal movement of the mast towards and away from ground level;

(f) link means operatively connected to said pivot means and said mast engaging means for providing a ballast suspension point below said pivot means, said link means depending downwardly below said pivot means in generally coaxial alignment with said mast engaging means; and (g) ballast means suspended from said link means for pivotally maintaining said mast engaging means substantially perpendicular and for stabilizing said mast assembly by establishing a center of gravity below said pivot means.

2. A mast assembly as claimed in claim 1 further comprising a support pad pivotably secured at a free end of each leg of the tripod to provide a platform therefor.

3. A mast assembly as claimed in claim 2 wherein the ballast means comprises a battery box and a battery disposed therein.

4. A mast assembly as claimed in claim 3 further comprising guying means interconnecting the free ends of the tripod legs and the battery box, guying means interconnecting said free ends and said mast, and guying means interconnecting said free ends, to form a generally rigid upstanding structure.

5. A mast assembly as claimed in claim 1 wherein the mast engaging means comprises one end of a mast socket bracket having a pair of parallel arms spaced apart and having at least one spacer adapted to receive and mechanically secure one end of a tubular mast.

6. A mast assembly as claimed in claim 5 wherein said link means comprise the other end of the parallel arms, each arm having an aperture and a pin interconnecting the arm ends.

7. A mast assembly as claimed in claim 6 wherein the pivot means comprise:

a centre pivot link having an aperture disposed at each end along an axis orthogonal to a corresponding axis at the other end;

a top pivot shaft pivotably joining one end of said pivot link between said pivot support arms through said apertures in said pivot support arms;

a pair of flanges disposed between the parallel arms and secured thereto in opposed relation; and a bottom pivot shaft pivotably joining the other end of said pivot link between said flanges.

8. A mast assembly as claimed in claim 7 further comprising a spoiler wrapped in spiral form around each leg of the tripod to reduce wind vibration induced by eddy shedding.

* * * * *